US005339061A

United States Patent [19]

Reick

[11] Patent Number: 5,339,061

[45] Date of Patent: Aug. 16, 1994

[54] IRON-FREE TRANSFORMER

[75] Inventor: Franklin G. Reick, Westwood, N.J.

[73] Assignee: Michael Ebert, New York, N.Y. ; a part interest

[21] Appl. No.: 68,784

[22] Filed: Jun. 1, 1993

[51] Int. Cl.[5] ..... H01F 1/00; H01F 5/00; H01F 27/28

[52] U.S. Cl. ..... 335/216; 335/299; 336/73; 336/195

[58] Field of Search ..... 335/299, 216; 336/73, 336/195, 180, 181, 182, 75, 77, 79, DIG. 1; 323/355, 360; 361/19, 141; 307/306, 277; 365/161; 330/195, 197, 188, 190, 165, 8

[56] References Cited

U.S. PATENT DOCUMENTS

| | | | |
|---|---|---|---|
| 1,504,276 | 8/1924 | Shackelton | 330/197 |
| 1,718,255 | 6/1929 | Ranzini . | |
| 2,606,968 | 8/1952 | Lindenblad . | |
| 3,143,720 | 8/1964 | Rogers | 336/155 |
| 3,253,242 | 6/1964 | Baycura | 336/73 |
| 3,617,908 | 11/1971 | Greber | 328/233 |
| 3,670,406 | 6/1972 | Weber | 29/593 |
| 3,686,467 | 8/1972 | Camras | 179/100.2 C |
| 3,742,408 | 6/1973 | Jaeger | 336/5 |
| 3,828,269 | 8/1974 | Norton | 330/97 |
| 3,885,213 | 5/1975 | Rioux | 324/127 |
| 4,050,013 | 9/1977 | Maddox . | |
| 4,065,351 | 12/1977 | Jassby | 176/5 |
| 4,264,827 | 4/1981 | Herzog | 307/17 |
| 4,967,141 | 10/1990 | Kiguchi | 323/360 |
| 5,012,125 | 4/1991 | Conway | 307/149 |
| 5,012,218 | 4/1991 | Haug | 336/174 |
| 5,182,537 | 1/1993 | Thuis | 336/180 |

FOREIGN PATENT DOCUMENTS 3037121 4/1981 Fed. Rep. of Germany ..... 330/165

OTHER PUBLICATIONS

"Pulse Transformer", IBM Technical Disclosure Bulletin, C. T. Lecher, vol. 2, No. 4, Dec. 1959.

*Primary Examiner*—Leo P. Picard
*Assistant Examiner*—Stephen T. Ryan
*Attorney, Agent, or Firm*—Michael Ebert

[57] ABSTRACT

An iron-free transformer in which electrical energy is transferred from a primary winding to a secondary winding without any electrical connection or inductive coupling therebetween. The transformer includes an iron-free conductive closed loop having input and output sections. Coiled about the input section to form the primary winding is a solenoidal flux tube whose ends are the input terminals of the transformer. Coiled about the output section is a solenoidal flux tube whose ends are the output terminals of the transformer. When the input terminals are connected to an alternating current source, the lines of flux in the electromagnetic field created by the primary flux tube winding do not intercept the secondary flux tube winding, but induce alternating current in the input section which is continuously circulated in the loop and flows through the output section thereof. The alternating current flowing through the output section induces an electromotive force in the secondary flux tube winding, causing an alternating current to flow in a load connected to the output terminals.

9 Claims, 1 Drawing Sheet

IRON-FREE TRANSFORMER

BACKGROUND OF INVENTION

1. Field of Invention

This invention relates generally to transformers for transferring electrical energy from a primary winding to a secondary winding, and more particularly to an iron-free transformer in which the transfer of energy is effected without any electrical connection or inductive coupling between the windings.

2. Status of Prior Art

A conventional transformer, whether a power transformer, an audio or radio frequency transformer, a modulation transformer or any other known type, functions to transfer energy from an input circuit or primary winding to an output circuit or secondary winding, by means of magnetic induction. The transfer of energy is effected by magnetic linkage between the circuits.

The principle underlying the operation of a conventional transformer is Faraday's law, which states that when the magnetic flux enclosed within a circuit varies, then induced in the circuit is an electrical current proportional to the rate of variation.

In its most elementary form, a conventional transformer consists of two coils wound of copper wire and inductively coupled to each other. When an alternating current of a given frequency flows in either coil, an electromagnetic force (emf) is induced in the other coil. The coil connected to an alternating current source is the primary winding of the transformer, and the emf produced across this winding is the primary emf. The emf induced in the other coil, which is the secondary winding, may be greater or less than the primary emf, depending on the ratio of primary to secondary turns which determine whether the transformer is a step-up or a step-down transformer.

Many transformers are provided with a stationary core of an iron alloy about which the primary and secondary windings are wound. Because of the high permeability of iron alloys or other ferromagnetic materials, most of the magnetic flux is concentrated in the core, and tight inductive coupling is thereby effected between the windings. Hence, the primary and secondary emf's bear almost exactly the same ratio to each other as the turns in the primary and secondary windings.

A conventional iron-core transformer has a high degree of efficiency, for the only losses encountered in transferring electrical energy are due to eddy currents set up in the iron core and heat generated as a result of the resistance of the copper windings.

There are some situations which require the transfer of energy, yet the use of an iron-core transformer for this purpose is not acceptable. Thus, one cannot use an iron-core transformer in the environment of a particle accelerator, for the intense, steady state magnetic fields which are produced in the accelerator will saturate an iron core and render the transformer inoperative. And there are other situations in which losses due to eddy currents induced in the iron core and heat produced by the resistance of the windings cannot be tolerated.

Thus in radio astronomy in which extremely weak radio signals originating in outer space are intercepted by an antenna and conveyed to a preamplifier, in order to prevent these signals from being buried in noise, it is the practice to convey the signals picked up by the antenna to the preamplifier by means of superconductive wires. These are maintained at a cryogenic temperature, that of liquid helium or liquid nitrogen, depending on the nature of the superconductor. In this context, one cannot step up the signal conveyed by the superconductive wires by means of a conventional transformer, for the losses encountered in such transformers will worsen the existing signal-to-noise ratio.

SUMMARY OF INVENTION

In view of the foregoing, the main object of this invention is to provide an iron-free transformer for efficiently transferring electrical energy from a primary winding to a secondary winding without any electrical connection between the windings or inductive coupling therebetween.

More particularly an object of this invention is to provide a transformer of the above type in which the primary winding to which alternating energy is applied induces an alternating current in one section of a closed non-ferric conductive loop which is circulated in the loop and conveyed to another section of the loop where it induces an electromotive force in a secondary winding coupled to that section.

Also an object of the invention is to provide an iron-free transformer of the above type in which the conductive loop and the primary and secondary windings are both formed of superconductive material so that the only losses experienced by the transformer are those resulting from the escape of magnetic flux from the transformer.

Briefly stated, these objects are attained in an iron-free transformer in which electrical energy is transferred from a primary winding to a secondary winding without any electrical connection or inductive coupling therebetween. The transformer includes an iron-free conductive closed loop having input and output sections. Coiled about the input section to form the primary winding is a solenoidal flux tube whose ends are the input terminals of the transformer. Coiled about the output section is a solenoidal flux tube whose ends are the output terminals of the transformer.

When the input terminals are connected to an alternating current source, the lines of flux in the electromagnetic field created by the primary flux tube winding do not intercept the secondary flux tube winding, but induce alternating current in the input section which is continuously circulated in the loop and flows through the output section thereof. The alternating current flowing through the output section induces an electromotive force in the secondary flux tube winding, causing an alternating current to flow in a load connected to the output terminals.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
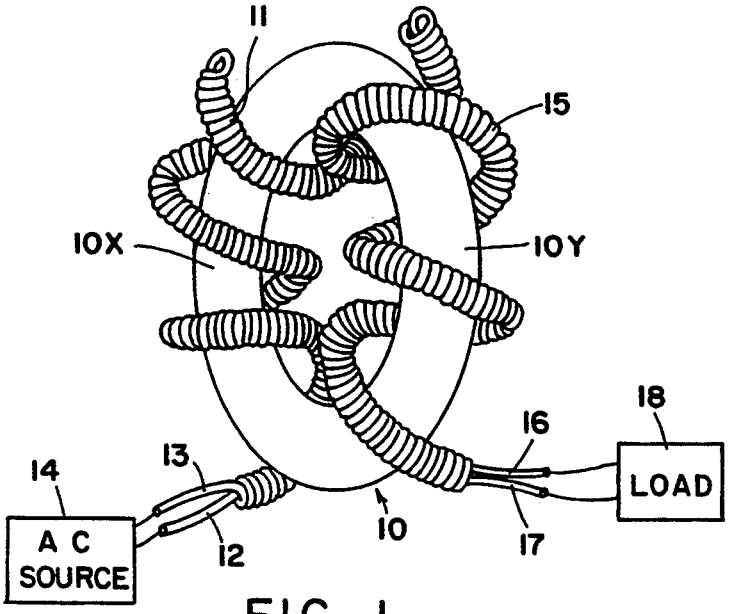
FIG. 1 schematically illustrates an iron-free transformer in accordance with the invention.

An iron-free transformer in accordance with the invention is illustrated in FIG. 1, the transformer including a short-circuited, conductive closed loop 10 formed of copper or other non-ferric, highly conductive metal. Loop 10 has an oval shape which defines an arcuate input section 10X on one side of the loop, and an arcuate output section 10Y on the opposite side of the loop. The configuration of the loop may take other forms, which depend on how many flux tube windings are mounted thereon and other factors.

Wound about section 10X of the loop to form a primary flux tube winding is a solenoidal flux tube 11. A solenoid is a wire-wound helical coil, which, when electrically energized by direct or alternating current, produces a magnetic field that resembles that of a bar magnet.

Figure 2:
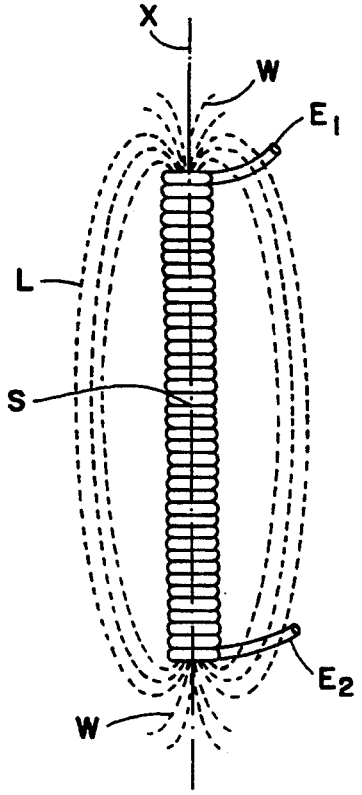
FIG. 2 shows a solenoidal flux tube for forming a transformer winding, the tube and the lines of flux produced thereby being shown when the tube is straight and before it is coiled about the transformer loop to create a flux tube winding.

FIG. 2 shows a straight solenoid S in the form of a wire-wound helical coil, the convolutions of which turn about a longitudinal axis X. When the wire ends $E_1$ and $E_2$ of this solenoid are connected to a current source, the resultant magnetic field is formed by lines of flux L which pass through the coil and extend from opposite ends of the coil in curved paths which interconnect these ends. Hence, these lines of flux surrounding the coil are more or less in the direction of axis X and do not intersect this axis.

Since the primary winding 11 of the transformer is a solenoidal flux tube that is wound about the input section 10X of loop 10, then the solenoid coil which constitutes the flux tube is itself coiled to create the primary flux tube winding. In other words, the lines of flux in the bar magnet field pattern are now spiralled about the conductive loop section to create a helical flux pattern. In the transformer, wire 12 emerging from the end convolution of flux tube winding 11 is inserted within this tube to pass out the other end thereof to form one input terminal 12 of the transformer, wire 13 extending from the other end of the flux tube winding forming the other input terminal.

Figure 3:
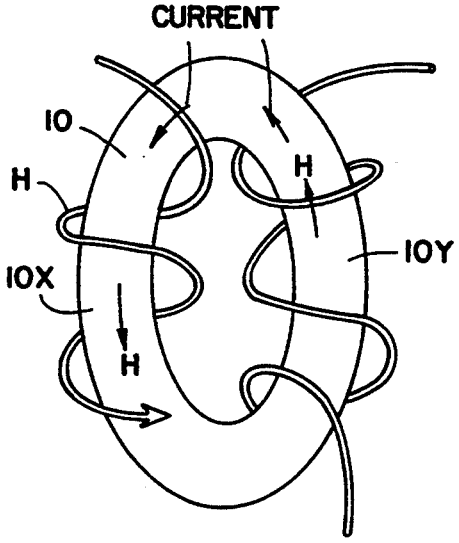
FIG. 3 shows schematically the lines of flux produced by the flux tube windings associated with the closed loop.

Hence, when input terminals 12 and 13 are connected to a source 14 of AC current to cause current to flow into flux tube winding 11, the resultant magnetic field H, as shown schematically in FIG. 3, is not in the shape shown in FIG. 2 for a straight solenoid, for now the lines of flux of the magnetic field are coiled about the input section 10X of loop 10 and intercept this conductive section to induce an AC current I in this section of the closed loop. This AC current circulates continuously in the closed loop and flows through the output section 10Y.

It is to be noted that if a wire were coiled about section 10X to form a solenoid, then if an AC current were to flow through this solenoid, the lines of flux of the electromagnetic field produced by this solenoid would run in the same direction as the section, and not intercept the section. Hence a current would not then be induced in the section.

Wound about output section 10Y as shown in FIG. 1, is a second solenoidal flux tube winding 15 whose length depends on the desired step-up or step-down ratio of the transformer, the wire ends 16 and 17 representing the output terminals of the transformer which are connectable to a load 18. When AC current is circulated in loop 10 and flows through output section 10Y, this current induces an emf in the secondary winding formed by flux tube 15 coiled about this section, resulting in a current flow in load 18 connected to the secondary flux tube winding.

Thus, the electrical energy from AC source 14 is transferred by the transformer to load 18 without any iron losses and without any inductive coupling between the flux tube windings.

In practice, to reduce heat losses arising from the resistance of loop 10, this loop may be made of a high-temperature, superconductive, copper-oxide ceramic which is rendered superconductive at the cryogenic temperature of liquid nitrogen. And the wires from which the primary and secondary flux tube windings are made can also be formed of superconductive material, so that these windings have zero resistance and heat losses are avoided.

The only losses that remain are those resulting from stray flux W, as shown in FIG. 2, which emerges from the ends of the solenoid. To minimize stray flux, in the transformer the ends of each flux tube winding are brought as close together as possible, for then stray flux from the ends reenter the tube and is not wasted.

Figure 4:
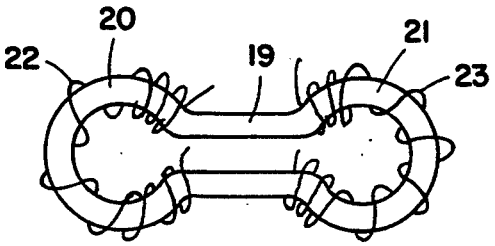
FIG. 4 shows another form of transformer loop adapted to cause the flux tubes wound thereabout to assume a toroidal configuration.

To make it possible to bring the ends of each flux tube winding in close proximity to each other, a transformer arrangement as in FIG. 4 is provided. In this setup, the closed conductive loop 19 is provided with generally ring-shaped input and output sections 20 and 21, a solenoidal flux tube 22 being wound about section 20 and a solenoidal flux tube 23 being wound about section 21.

In this way, each solenoidal flux tube wound about the loop has a toroidal form in which the ends of the tube are close to each other to minimize flux leakage. It is also desirable that the convolutions of the solenoid be as close together as possible. And whatever the transformer arrangement, the flux tubes wound about sections of the loop must not be inductively coupled to each other.

While there have been shown and described preferred embodiments of an iron-free transformer in accordance with the invention, it will be appreciated that many changes and modifications may be made therein without, however, departing from the essential spirit thereof. Thus, each flux tube winding may consist of several layers of flux tubes wound about a section of the closed conductive loop, rather than a single layer, as shown.

I claim:

1. A transformer for transferring electrical energy from a primary flux tube winding to a secondary flux tube winding without any electrical connection or inductive coupling therebetween, said transformer comprising:

(a) an iron-free, non-magnetic, closed-circuit, electrically-conductive loop having input and output sections:

(b) a first solenoidal flux tube formed by an elongated helix, said helix being spiralled about said input section to form said primary flux tube winding, whereby an AC current flowing through this winding creates an electromagnetic filed whose lines of flux spiral about the section to induce therein an alternating current that circulates through the loop and flows through the output section; and (c) a second solenoidal flux tube formed by an elongated helix, said helix being spiralled about said output section to form said secondary flux tube winding, whereby the current flowing through the output section of the loop includes an EMF in the secondary flux tube winding which causes a current flow in a load coupled to the secondary winding.

2. A transformer as set forth in claim 1, wherein said loop is formed of copper.

3. A transformer as set forth in claim 1, wherein said loop is formed of superconductive material.

4. A transformer as set forth in claim 3, wherein said primary and secondary flux tube windings are formed of superconductive wire.

5. A transformer as set forth in claim 3, wherein superconductive material of the loop and of the wire is a high temperature superconductor that is rendered superconductive at the temperature of liquid nitrogen.

6. A transformer as set forth in claim 1, wherein said second flux tube has a different number of turns than said first flux tube.

7. A transformer as set forth in claim 1, in which the loop has an oval form, the input section being on one side thereof and the output section on the opposite side.

8. A transformer as set forth in claim 1, in which the loop has on opposing sides thereof ring-shaped sections, one being the input section and the other the output section.

9. A transformer as set forth in claim 8, in which the first and second tubes wound about the input and output sections produce primary and secondary flux tube windings having a toroidal form.

* * * * *